US005491914A

United States Patent [19]

Negishi

[11] Patent Number: 5,491,914

[45] **Date of Patent: * Feb. 20, 1996**

[54] BUCKET EQUIPPED WITH MIXING DEVICE, EXCAVATION MACHINE HAVING THE BUCKET, AND SOIL IMPROVEMENT METHOD USING THE EXCAVATION MACHINE

[76] Inventor: Jinichiro Negishi, 3533, Shichihongi, Kamisatomachi, Kodama-gun, Saitama-ken, Japan

[ * ] Notice: The portion of the term of this patent subsequent to Aug. 8, 2014, has been disclaimed.

[21] Appl. No.: 288,277

[22] Filed: Aug. 8, 1994

Related U.S. Application Data

[63] Continuation of Ser. No. 981,743, Nov. 24, 1992, Pat. No. 5,379,534.

[51] Int. Cl.[6] ..... E02F 3/96

[52] U.S. Cl. ..... 37/403; 37/444; 37/903

[58] Field of Search ..... 37/403, 379, 443–445, 37/901, 903, 241, 243, 264, 341

[56] References Cited

U.S. PATENT DOCUMENTS

| | | | |
|---|---|---|---|
| 3,891,342 | 6/1975 | Roe | 37/444 |
| 4,003,288 | 5/1977 | Roe | 37/403 |
| 4,803,789 | 2/1989 | Hackmack | 37/403 |
| 4,818,390 | 4/1989 | Manchak, Jr. | 37/342 |
| 4,852,277 | 8/1989 | Ward | 37/403 |
| 5,040,900 | 8/1991 | Boggs | 37/195 |

FOREIGN PATENT DOCUMENTS

| | | | |
|---|---|---|---|
| 58-50156 | 9/1981 | Japan . | |
| 59-88528 | 11/1982 | Japan . | |
| 60-15955 | 3/1984 | Japan . | |
| 1-119443 | 1/1988 | Japan . | |
| 1162903 | 6/1985 | U.S.S.R. | 37/445 |

*Primary Examiner*—Randolph A. Reese
*Assistant Examiner*—Spencer K. Warnick, IV
*Attorney, Agent, or Firm*—Ladas & Parry

[57] ABSTRACT

A bucket equipped with a mixing device for use in work for improving the soil of grounds such as road grounds, an excavation machine having such a bucket, and a soil improvement method using such an excavation machine. The bucket is equipped with a mixing device disposed therein, which device can be rotated by a motor whose number of revolutions per unit time is adjustable, and has an opening formed through the bottom surface thereof. Further, the bucket includes an injection device connected to an external, solidifying agent supply source.

13 Claims, 7 Drawing Sheets

BUCKET EQUIPPED WITH MIXING DEVICE, EXCAVATION MACHINE HAVING THE BUCKET, AND SOIL IMPROVEMENT METHOD USING THE EXCAVATION MACHINE

This is a continuation of Ser. No. 07/981,743 filed on Nov. 24, 1992 now U.S. Pat. No. 5,379,534.

BACKGROUND OF THE INVENTION

1. Field of the Invention

The present invention relates to a bucket equipped with a mixing device for use in work for improving the soil of grounds such as road grounds, to an excavation machine having such a bucket, and to a soil improvement method using such an excavation machine.

2. Related Prior Art

Improvement work for improving certain grounds such as roadbeds or poor grounds has been hitherto performed, in which soil having poor properties is mixed with materials such as cement or lime to thereby convert the grounds into grounds with strong properties.

Recently, in such ground improvement work, instead of a method in which soil whose properties have already been improved in a remote soil improvement plant is buried at the site, another method has come into frequent use. In the second method, a surface layer of the ground is directly solidified in situ. For this purpose, a special category of machines is used at the site: a mixing machine, such as a stabilizer, shown in FIG. 12.

The second method will be described with reference to FIG. 12. First, a prescribed solidifying agent is sprayed on the site of the soil improvement work. Then, the stabilizer is caused to travel over the agent applied ground in the direction A shown in FIG. 12. A work machine rotor, provided at a rear portion of the stabilizer, is caused to excavate the ground, thereby mixing the soil of the excavated ground with the sprayed solidifying agent. Thus, the soil of the ground is improved.

However, grounds such as roadbeds for ordinary roads and grounds for building areas generally have underground structures buried therein, such as electricity and telephone cables, and water and gas supply pipes. In addition, associated facilities, such as manholes, are provided underground.

Therefore, when performing ground improvement work with a stabilizer on the surface of grounds having such underground obstacles, the work must be performed while underground structures are detected. As a result, the work entails a high risk of damaging underground structures, and low operational efficiency. Another disadvantage is that a mixing operation may not be completely performed since improvement work is sometimes restrained for the sake of safety near underground structures which might be damaged. As a result, the work may leave many portions of the ground unimproved, and thus, fail to assure thorough improvement.

After spraying the solidifying agent, the stabilizer travels on crawlers or wheels over the sprayed solidifying agent. This is disadvantageous in that some of the agent is scattered, contaminating the work environment.

SUMMARY OF THE INVENTION

The present invention has been made in order to eliminate the above disadvantages. An object of the present invention is to provide a bucket equipped with a mixing device that enables efficient and rational soil improvement work, provide an excavation machine having such a bucket, and provide a soil improvement method using such an excavation machine.

In order to achieve the above object, according to the present invention, there is provided a bucket equipped with a mixing device, comprising: a pair of side plates defining a pair of opposing side surfaces; a bottom plate defining a bottom surface, the side and bottom plates together defining the interior of the bucket having a fixed capacity; and a mixing device disposed in the bucket for mixing a fixed amount of contents of the bucket excavated thereby.

The mixing device may be rotated by a motor whose number of revolutions per unit time is adjustable. The mixing device may include a shaft rotatable by the motor, a plurality of arms provided on the shaft at certain intervals, and mixing blades mounted on the distal ends of the arms.

The mixing device may alternatively include a shaft rotatable by the motor, and mixing blades individually provided on the shaft at certain intervals, the mixing blades being mounted on the shaft at individual angles.

The bottom plate of the bucket may have at least one opening formed therethrough, the number of openings being selected in accordance with the properties of the soil of the relevant ground, and the nature of the work.

The present invention also provides a soil improvement method using such a bucket as an attachment to an excavation machine. The method comprises: spraying a solidifying agent on the surface of the ground to be excavated; operating the bucket to excavate the ground sprayed with the solidifying agent and scope some of the ground as well as some of the solidifying agent; mixing the scooped ground with the solidifying agent by the mixing device in the bucket; and discharging the resultant mixture at a desired place.

The above-described bucket may further comprises an injection device connected to an external, solidifying agent supply source.

The present invention also provides an excavation machine having, as an attachment thereto, a bucket equipped with such an injection device.

With the above-described construction of the present invention, since the bucket according to the present invention has a fixed capacity, it is possible to mix a fixed amount of solidifying agent with soil, thereby enabling fixed-amount mixing. Thus, it is possible to perform efficient operations.

DESCRIPTION OF THE PREFERRED EMBODIMENTS

Embodiments of the present invention will now be described with reference to the drawings.

Figure 1:
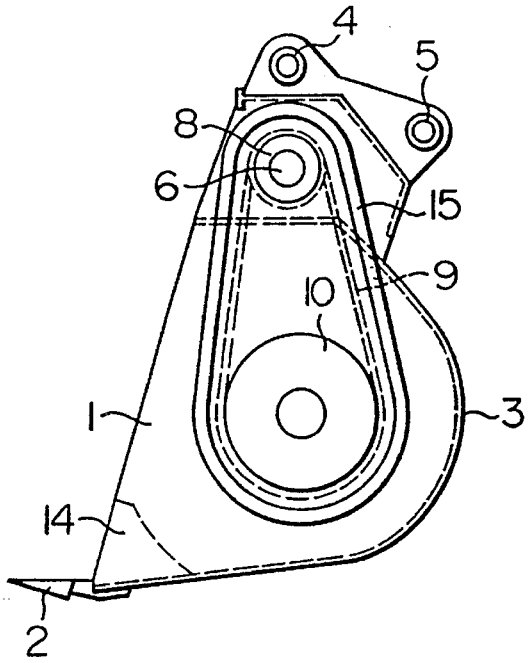
FIG. 1 is a side view of a first embodiment of a bucket equipped with a mixing device according to the present invention.
Figure 2:
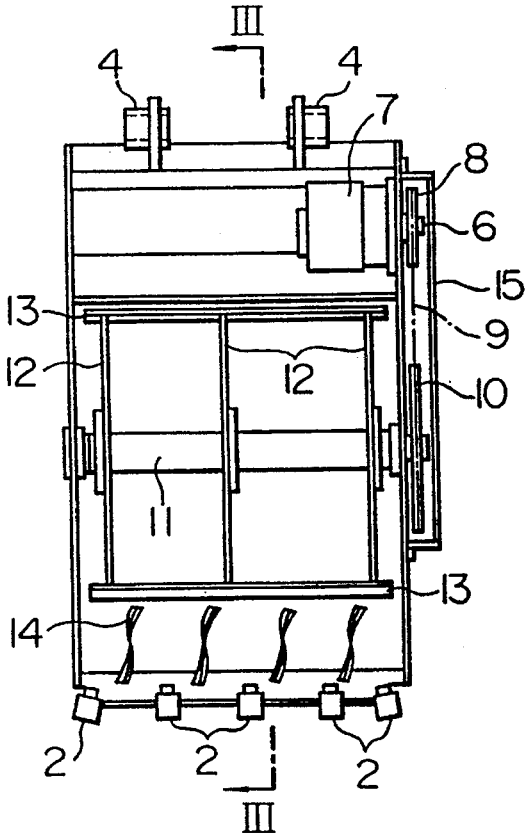
FIG. 2 is a plan view showing the inside of the bucket shown in FIG. 1.
Figure 3:
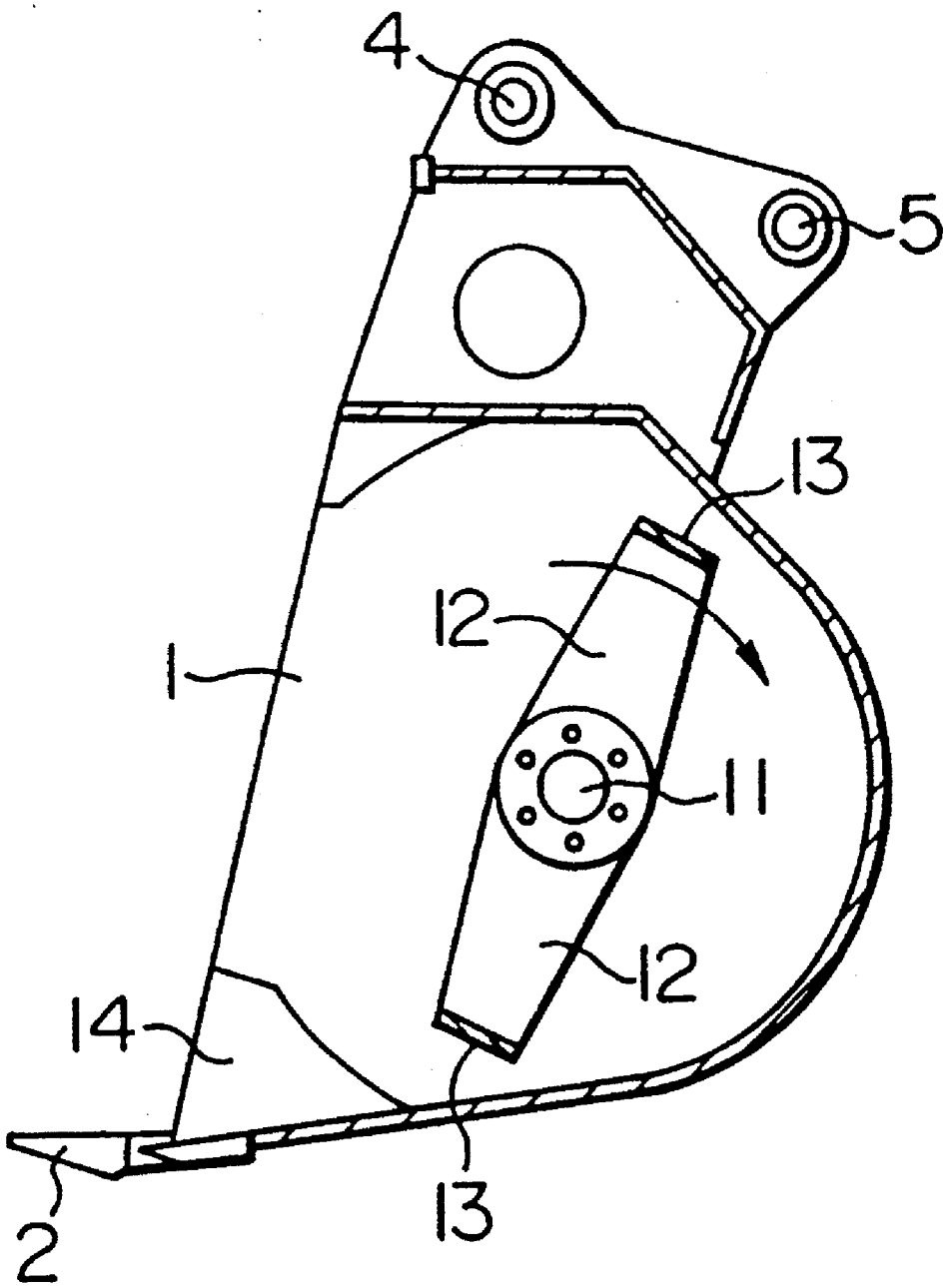
FIG. 3 is a sectional view taken along the line III—III shown in FIG. 2.
Figure 4:
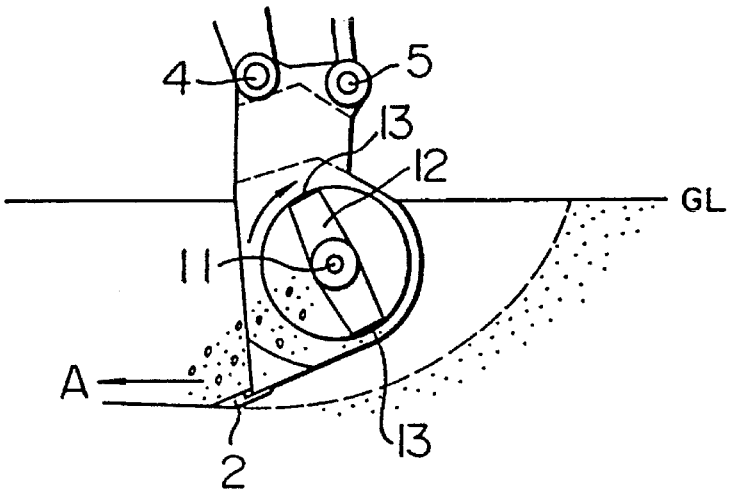
FIG. 4 is a view showing an excavating process for explaining the operation of the first embodiment.
Figure 5:
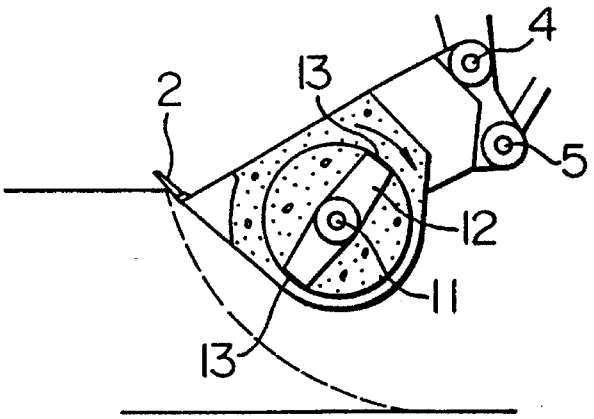
FIG. 5 is a view showing a mixing process for explaining the same.
Figure 6:
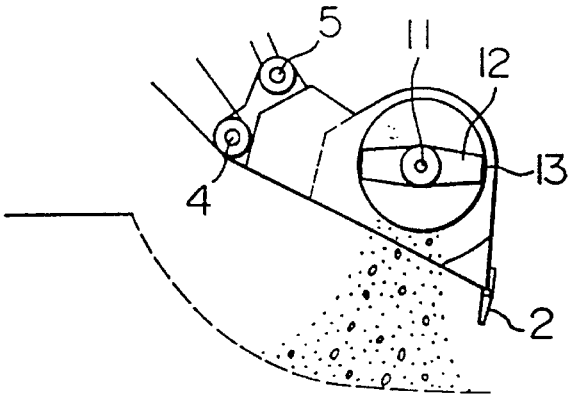
FIG. 6 is a view showing a discharging process for explaining the same.

A first embodiment of a bucket equipped with a mixing device according to the present invention is shown in FIGS. 1 to 3 in side view, inward plan view and sectional view, respectively. FIGS. 4, 5 and 6 will be referred to to explain the operation of the first embodiment.

Referring to FIGS. 1 to 3, the bucket includes a pair of opposing side plates 1. A plurality of pawls 2 are provided at the forward end of the bucket. A bottom plate 3 is formed with a curved contour, and defines, together with the side plates 1, the interior of the bucket having a fixed capacity. Arm bearings 4 are adapted to mount on a base machine (not shown) on which the bucket is to be mounted, such as an excavator (back-hoe), a type of machine most commonly used in civil engineering works. A link bearing 5 is adapted to be connected to a link mechanism of the excavator. A shaft 6 is connected to a motor 7 (shown in FIG. 2), and a small sprocket 8 is integral with the shaft 6. A chain 9 is able to transmit the drive force of the small sprocket 8 to another shaft 11 through a large sprocket 10. A plurality of arms 12 are provided on the shaft 11 at certain intervals. Mixing blades 13, forming a U-shaped structure, are fixed to the distal ends of the arms 12. The mixing blades 13 are rotatable by the drive force of the motor 7.

The mixing blades need not be in the form of a U-shaped structure, and may alternatively comprise individual mixing blades, as will be described later.

A plurality of crushing plates 14 are provided behind the pawls 2. The crushing plates 14 have a twist angle so as to be able to invert and crush excavated soil. Further, the crushing plates 14 serve to prevent damage to the mixing blades, arms, etc. which can be caused when these members bite coarse cobbles, coarse masses of concrete or the like which have entered the bucket. A chain case 15 is provided for the chain 9.

The operation of the bucket equipped with a mixing device, having the above-described construction, will be explained with reference to FIGS. 4 to 6.

First, as shown in FIG. 4, the body of the bucket is introduced into the ground to be excavated, such as a roadbed, and the ground is excavated with the bucket by moving it in the direction indicated by arrow A. In this process, a predetermined amount of a solidifying agent (not shown) has already been sprayed on the surface of the ground. As a result, the excavation causes some of the solidifying agent to be taken into the bucket as well as the soil. In the bucket, the mixing blades 13 rotate in the direction indicated by the associated arrow. Accordingly, the solidifying,agent and the soil, thus taken in, are sufficiently mixed together in the bucket. As described before, the crushing plates 14 act to separate out cobbles, concrete masses, etc. Thus, an excavation process is shown in FIG. 4.

When any stones, concrete masses, etc. have been caught between the mixing blades 13 and the bottom plate 3, they can be removed by rotating the blades 13 in the opposite direction.

FIG. 5 shows the process of scooping the contents of the bucket. The process is also a mixing process. In this process, the arms 12 act to slit the soil held in the bucket into several elongated portions, and invert them, thereby fragmenting the viscous component of the soil. Meanwhile, the mixing blades 13 within the bucket act to effect sufficient mixing.

FIG. 6 shows a discharging process, in which the soil scooped and mixed in the process shown in FIG. 5 is discharged.

With the above-described embodiment, it is possible to effect fixed-amount mixing because a predetermined amount of a solidifying agent determined in accordance with a desired mixing ratio is sprayed beforehand on the ground surface, and because a fixed amount of soil is excavated into the bucket. Further, mixing within the bucket makes it possible to prevent contamination of the peripheral area due to scattered particles of soil, etc.

Since the number of revolutions of the motor per unit time can be freely adjusted, it is possible to cope with changes in the properties of the soil, which may be viscous soil, sand, peat, etc. Further, since the bucket is an attachment, it is possible to replace the bucket only, thereby enabling reductions in operating costs.

Figure 7:
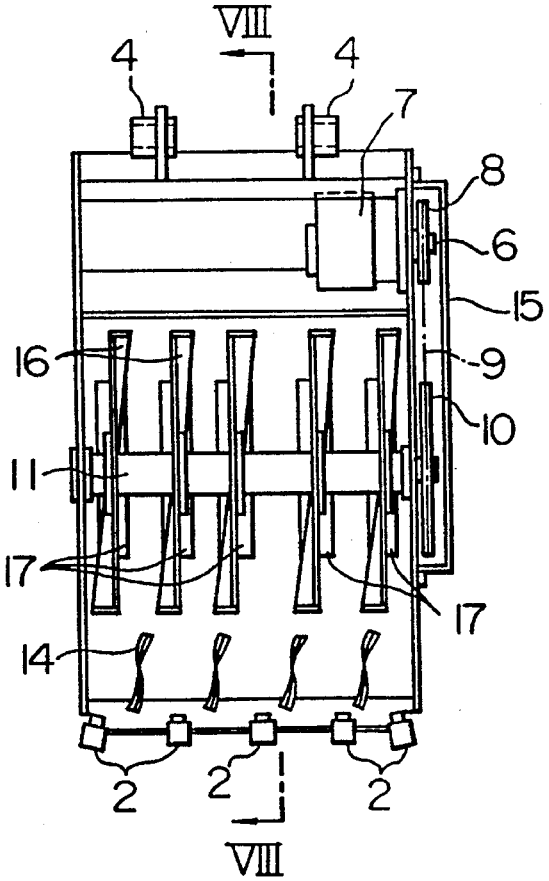
FIG. 7 is a plan view of a second embodiment of the present invention.

FIG. 7 shows, in a plan view, a second embodiment of the present invention. Component parts which are the same as those shown in FIG. 2 are denoted by identical reference numerals, and their description will be omitted.

Figure 8:
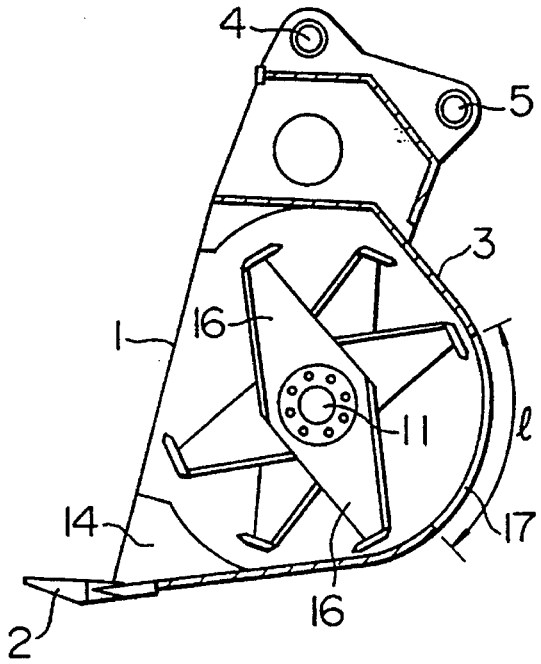
FIG. 8 is a sectional view taken along the line VIII—VIII shown in FIG. 7.

In FIG. 7, a plurality of mixing blades 16 are individually provided on the shaft 11, and the individual mixing blades 16 are mounted on the shaft 11 at individual angles. In the illustrated example, the mixing blades have a twist angle. A plurality of openings 17 are formed through the bottom plate 3 in correspondence with the mixing blades 16. In FIG. 8, a sectional view taken along the line VIII—VIII shown in FIG. 7, the longitudinal length of the openings 17 is represented by curve length l.

The operation of the second embodiment will be described with reference to FIGS. 9 to 11.

Figure 9:
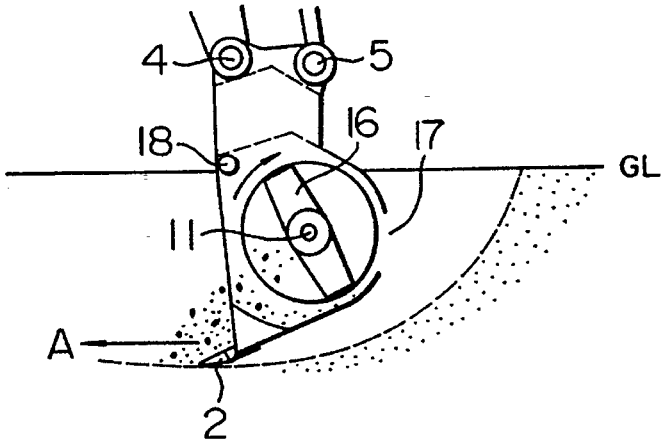
FIG. 9 is a view showing an excavating process for explaining the operation of the second embodiment.

FIG. 9 shows a state in which the body of the bucket is introduced into the ground, such as a roadbed, and moved in the direction indicated by arrow A with some soil being taken into the body of the bucket. A solidifying agent may be supplied by either of the following: a method in which a predetermined amount of the solidifying agent is sprayed on the ground surface, and then taken into the bucket together with soil; and a method in which the shaft 11 is utilized as an injection pipe connected to an external, solidifying agent supply source so that the solidifying agent can be injected through holes formed in the peripheral edges of the shaft 11. In the second method, injection into the bucket may be alternatively effected from a predetermined position in the interior of the bucket, such as an injection pipe 18, shown in FIG. 9.

In this process, at the entrance of the bucket, the crushing plates 14 twist soil being taken in, and remove coarse cobbles, concrete masses, etc. Then, in the interior of the bucket, the mixing blades 16, with a twisted configuration, further remove such coarse components.

Figure 10:
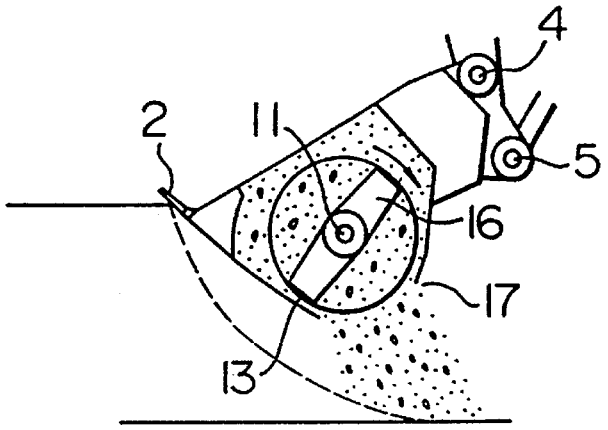
FIG. 10 is a view showing a mixing process for explaining the same.

FIG. 10 shows a scooping process. A portion of the soil twisted in two stages by the crushing plates 14 and the mixing blades 16 is discharged, in its mixed state, through the openings 17 formed in the bottom plates 3 and directed rearward.

Figure 11:
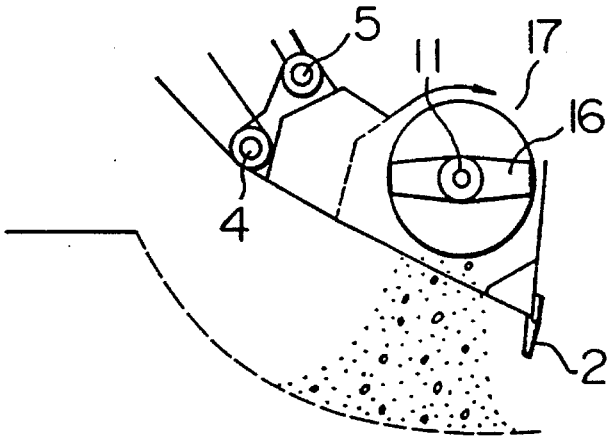
FIG. 11 is a view showing a discharging process for explaining the same.
Figure 12:
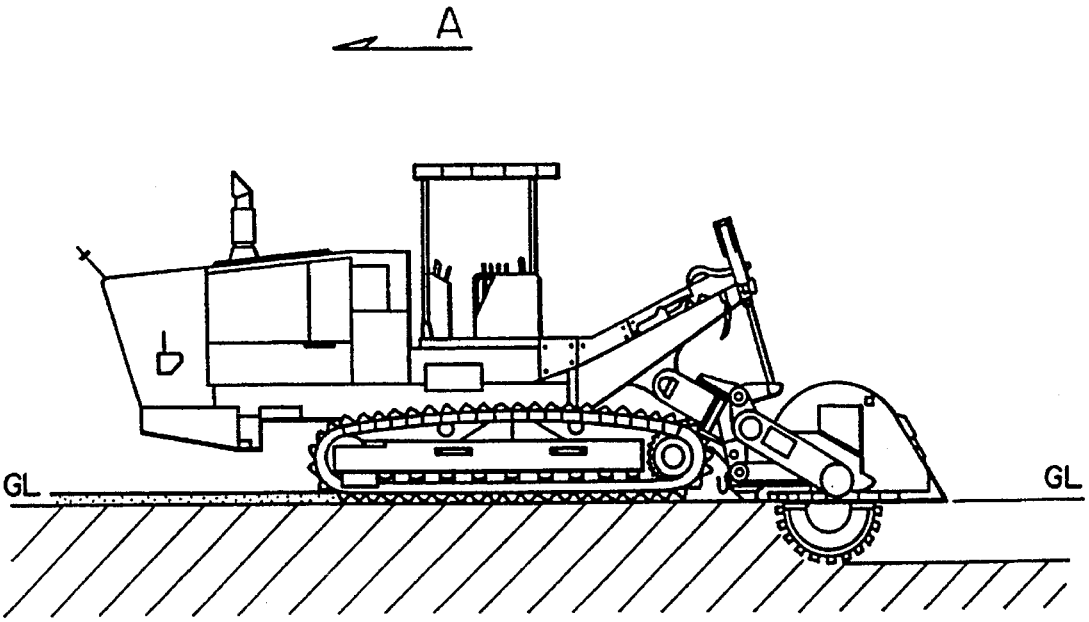
FIG. 12 PRIOR ART
FIG. 12 a side view of a conventional stabilizer.

In this process, only a part of the mixed soil is discharged through the openings 17, and the remaining part is discharged in the subsequent discharging process shown in FIG. 11.

Although in the second embodiment, the number of the openings 17 and their positions are in 1:1 correspondence with those of the mixing blades 16, the present invention is not intended to be limited thereto. Rather, the correspondence may not be 1:1, and suitable changes in the position and size of the openings make it possible to improve mixing efficiency.

In the foregoing embodiments, the motor may be substituted by another form of drive source such as one having a hydraulic cylinder or a flexible rotary shaft.

With the foregoing embodiments, the variety of sites at which the soil improvement work can be performed is not limited so long as the site is within the reach of the arm of the base machine even in such areas as the vicinity of underground structures, the surfaces of grounds where pipes for gas and electricity supplies or pipes for water supply and sewage systems have been reburied, narrow places, or sloped surfaces. Accordingly, operational efficiency is good. In addition, if there is any underground structure, the pawls provided at the forward end of the bucket abut against the structure during excavation, and the operator of the excavator is able to perceive the abutment shock. Accordingly, it is possible to prevent damage to the underground structure. This in turn makes it possible to perform careful excavating operations, and eliminate the need to restrain work.

As described above, according to the present invention, the following advantageous effects are provided:

① The operation can be performed with precise mixing ratios and high efficiency.

② Shingles, scrap, and viscous soil wound on the mixing blades are shaken off from the blades under the centrifugal force thereof, and are then discharged through the opening, thereby eliminating the risk of a braking action.

③ Loose soil components having high fluidity, such as sludge and fine sand, are smoothly mixed and discharged, thereby increasing operational efficiency.

④ By virtue of effect ③, highly-fluid, loose soil components are subjected to excavating and discharging processes simply by moving the bucket horizontally while maintaining it in an underground position, thereby curtailing the time requirement.

⑤ If the crushing plates are twisted in the direction opposite to the mixing blades, it is possible to further improve the mixing extent.

⑥ If a device solely for the purpose of injection is provided at a desired position in the interior of the bucket, the constant supply of a solidifying agent from the outside is possible, thereby enabling the solidifying agent to be sprayed simultaneously with mixing.

What is claimed is:

1. A bucket equipped for use with an excavation machine for improvement of ground, the bucket comprising:

a pair of side plates defining a pair of opposing side surfaces, a bottom plate defining a bottom surface having at least one opening through which ground can be discharged;

excavating edge means on said bottom surface for excavating the ground and for enabling at least a portion of the excavated ground to be scooped into the bucket; said excavating edge means comprising a plurality of excavating pawls;

mixing means for mixing the ground excavated by said excavating edge means in the bucket; said mixing means being disposed in the bucket between said excavating edge means and said at least one opening such that ground excavated and scooped into the bucket using said excavating edge means can be mixed by said mixing means, and then discharged through said at least one opening.

2. A bucket as claimed in claim 1, wherein said bucket further comprises injection means for injecting solidifying agent into the bucket to improve ground scooped into the bucket.

3. A bucket as claimed in claim 2, wherein said mixing means includes a shaft rotatable by a motor, a plurality of arms provided on said shaft at predetermined intervals, and mixing blades mounted on the ends of said arms.

4. A bucket as claimed in claim 1 wherein said at least one opening is of a size suitable for adapting the bucket to properties of the ground being mixed.

5. A bucket as claimed in claim 1 wherein the bottom plate defines a bottom surface having a plurality of openings of a size and number suitable for adapting the bucket to properties of the ground.

6. An excavation machine for improvement of ground, said machine comprising:

a) a bucket which comprises:

i) a pair of side plates defining a pair of opposing side surfaces;

ii) a bottom plate defining a bottom surface having at least one opening through which ground can be discharged;

iii) excavating edge means on said bottom surface for excavating the ground and for enabling at least a portion of the ground so excavated to be scooped into the bucket; said excavating edge means comprising a plurality of excavating pawls;

iv) mixing means for mixing the ground excavated into the bucket; said mixing means being disposed in the bucket between said excavating edge means and said opening such that ground excavated and scooped into the bucket using said excavating edge means can be mixed by said mixing means and then discharged through said at least one opening; and b) means for moving the bucket to cause the bucket to excavate the ground and to scoop the excavated ground into the bucket such that the excavated ground so scooped can be mixed by said mixing means and then discharged through said at least one opening.

7. An excavation machine as claimed in claim 6, said bucket further comprising injection means for injecting solidifying agent into the bucket to improve ground scooped into the bucket.

8. An excavation machine as claimed in claim 7, wherein said mixing means includes a shaft rotatable by a motor, a plurality of arms provided on said shaft at predetermined intervals, and mixing blades mounted on the ends of said arms.

9. A ground improvement method using an excavation machine as recited in claim 7, said method comprising the steps of:

moving said bucket in an arc having a substantial vertical component so as to cause the bucket to excavate the ground and to scoop at least some of the ground into the bucket;

spraying a solidifying agent through said injection means to the excavated ground in the bucket;

mixing the scooped ground with the solidifying agent by the mixing means in the bucket; and discharging at least a part of the resultant mixture from the bucket through said at least one opening.

10. A ground improvement method using an excavation machine as recited in claim 6, said method comprising the steps of:

spraying a solidifying agent on the ground to be excavated;

moving said bucket in an arc having a substantial vertical component so as to cause the bucket to excavate the ground sprayed with the solidifying agent and to scoop at least some of the ground and at least some of the solidifying agent into the bucket;

mixing the scooped ground with the solidifying agent by the mixing means in the bucket; and discharging the resultant mixture through said opening.

11. A bucket equipped for use with an excavation machine for improvement of ground, the bucket comprising:

a pair of side plates defining a pair of opposing side surfaces;

a bottom plate having a front portion and a rear portion with an opening therein;

excavating edge means on said front portion for excavating the ground and for enabling at least a portion of the excavated ground to be scooped into the bucket, said excavating edge means comprising a plurality of excavating pawls;

mixing means for mixing the ground excavated by said excavating edge means in the bucket, said mixing means being disposed in the bucket between said excavating edge means and said rear portion such that ground excavated and scooped into the bucket using said excavating edge means can be mixed by said mixing means, and then passed to said rear portion, said rear portion comprising surface means for allowing a first portion of ground passed to said rear portion to be discharged through the opening while maintaining a second portion of ground passed to said rear portion in the bucket.

12. A bucket as claimed in claim 11 wherein said surface means comprises a plurality of openings.

13. A bucket as claimed in claim 12 wherein said mixing means comprising a plurality of mixing blades which correspond in number to the plurality of openings.

* * * * *